US006908730B2

(12) United States Patent
Parton et al.

(10) Patent No.: US 6,908,730 B2
(45) Date of Patent: Jun. 21, 2005

(54) SILVER HALIDE MATERIAL COMPRISING LOW STAIN ANTENNA DYES

(75) Inventors: Richard L. Parton, Webster, NY (US); Thomas L. Penner, Fairport, NY (US); David R. Foster, Rochester, NY (US); Stephen A. Hershey, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 109 days.

(21) Appl. No.: 10/347,014

(22) Filed: Jan. 17, 2003

(65) Prior Publication Data

US 2004/0146818 A1 Jul. 29, 2004

(51) Int. Cl.[7] ..... G03C 1/005

(52) U.S. Cl. ..... 430/572; 430/570; 430/574; 430/559; 430/577; 430/581; 430/576

(58) Field of Search ..... 430/570, 572, 430/574, 555, 577, 501, 576

(56) References Cited

U.S. PATENT DOCUMENTS

| | | | | |
|---|---|---|---|---|
| 3,622,316 | A | 11/1971 | Bird et al. | |
| 6,048,681 | A | 4/2000 | Suzumoto et al. | |
| 6,117,629 | A | 9/2000 | Yamashita et al. | |
| 6,143,486 | A | 11/2000 | Parton et al. | |
| 6,165,703 | A | 12/2000 | Parton et al. | |
| 6,312,883 | B1 | 11/2001 | Parton et al. | |
| 6,329,133 | B1 | 12/2001 | Andrievsky et al. | |
| 6,331,385 | B1 | 12/2001 | Deaton et al. | |
| 6,361,932 | B1 | 3/2002 | Parton et al. | |
| 6,558,893 | B1 * | 5/2003 | Parton et al. | 430/574 |
| 6,620,581 | B1 * | 9/2003 | Parton et al. | 430/559 |

FOREIGN PATENT DOCUMENTS

| | | |
|---|---|---|
| EP | 1 061 411 A1 | 12/2000 |
| EP | 0 838 719 B1 | 2/2003 |
| JP | 10/171058 | 6/1998 |

OTHER PUBLICATIONS

Thomas L. Penner et al, *Photographic Science and Engineering,* "Spectral Shifts and Physical Layering of Sensitizing Dye Combinations in Silver Halide Emulsions", vol. 20, 1976, pp. 97–106.

Thomas L. Penner, *Photographic Science and Engineering*, "Electrophoresis of Spectral Sensitizing Dyes on Silver Halide: Evidence for Dye Layering", vol. 21, 1977, pp. 32–36.

IP.com publication 000006637D published Jan. 17, 2002, pp. 1–51.

U.S. Appl. No. 10/346,745 filed Jan. 17, 2003 "A Method of Making a Silver Halide Photographic Material Having Enhanced Light Absorption and Low Fog" of David R. Foster et al.

* cited by examiner

*Primary Examiner*—Geraldine Letscher
(74) *Attorney, Agent, or Firm*—Sarah Meeks Roberts

(57) ABSTRACT

This invention relates to a silver halide photographic material comprising at least one silver halide emulsion comprising silver halide grains having associated therewith:

(a) a first dye (Dye 1) that is a cyanine dye capable of spectrally sensitizing a silver halide emulsion and that has at least one anionic substituent; and (b) a second dye (Dye 2) that is not a cyanine dye and that has at least one cationic substituent. Dye 2 has a log P, excluding any counterion, of less than 4.00 and greater than 1.00 or Dye 2 is represented by a dye of formula II as described herein.

15 Claims, No Drawings

SILVER HALIDE MATERIAL COMPRISING LOW STAIN ANTENNA DYES

FIELD OF THE INVENTION

This invention relates to a silver halide photographic material with enhanced light absorption, improved sensitivity and acceptable dye stain. It further relates to a silver halide photographic material comprising a silver halide emulsion that is dye layered and that is associated with a specific class of antenna dye.

BACKGROUND OF THE INVENTION

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to the increased surface area per mole of silver. However, in most photographic systems, it is still the case that not all of the available light is being collected.

The need is especially great in the blue spectral region where a combination of low source intensity and relatively low dye extinction results in a deficient photoresponse. The need for increased light absorption is also great in the green sensitization of the magenta record of multilayer color film photographic elements. The eye is most sensitive to the magenta image dye and this layer has the largest impact on color reproduction. Higher speed in this layer can be used to obtain improved color and image quality characteristics. The cyan layer could also benefit from increased red-light absorption that could allow the use of smaller emulsions with less radiation sensitivity and improved color and image quality characteristics. For certain applications, it may be useful to enhance infrared light absorption in infrared sensitized photographic elements to achieve greater sensitivity and image quality characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.,* 18, 562 (1974)). One method is to synthesize molecules in which two dye chromophores are covalently connected by a linking group (see U.S. Pat. Nos. 2,518,731; 3,976,493; 3,976,640; 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion; however, they tended to sensitize poorly and dye stain (an unwanted increase in D-min due to retained sensitizing dye after processing) was severe in this system and unacceptable.

A different strategy involves the use of two dyes that are not covalently linked to one another. In this approach the dyes can be added sequentially and are less likely to interfere with each other. Miyasaka et al. in EP 270 079 and EP 270 082 describe silver halide photographic material having an emulsion spectrally sensitized with an adsorbable sensitizing dye used in combination with a non-adsorbable luminescent dye that is located in the gelatin phase of the element. Steiger et al. in U.S. Pat. No. 4,040,825 and U.S. Pat. No. 4,138,551 describe a silver halide photographic material having an emulsion spectrally sensitized with an adsorbable sensitizing dye used in combination with a second dye that is bonded to gelatin. The problem with these approaches is that unless the dye that is not adsorbed to the grain is in close proximity to the dye adsorbed on the grain (less than 50 angstroms separation) efficient energy transfer will not occur (see T. Förster, *Disc. Faraday Soc.,* 27, 7 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.,* 27, 59 (1983)).

A more useful method is to have two or more dyes form layers on the silver halide grain. Penner and Gilman described the occurrence of greater than monolayer levels of cyanine dye on emulsion grains, *Photogr. Sci. Eng.,* 20, 97 (1976); see also Penner, *Photogr. Sci. Eng.,* 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. A problem with previous dye layering approaches was that the dye layers described produced a very broad sensitization envelope. This may be desirable for some black and white photographic applications, but in a multilayer color film element this would lead to poor color reproduction since, for example, the silver halide grains in the same color record would be sensitive to both green and red light.

Yamashita et al. (EP 838 719 A2, U.S. Pat. No. 6,117,629) describes the use of two or more cyanine dyes to form more than one dye layer on silver halide emulsions. The dyes are required to have at least one aromatic or heteroaromatic substituent attached to the chromophore via the nitrogen atoms of the dye. Yamashita et al. teaches that dye layering will not occur if this requirement is not met. This is undesirable because such substitutents can lead to large amounts of retained dye after processing (dye stain) that affords increased D-min. Similar results are described in U.S. Pat. No. 6,048,681 and EP 1,061,431 A1. EP 1,061,411 A1 describes forming dye layers by using dyes with additional polycyclic rings. The dyes have at least one heterocyclic ring that has two or more additional rings attached to it. This may promote dye-dye interactions by increasing van der Waals forces, however, adding hydrophobic, aromatic rings to the dye molecules is undesirable in that the dyes are more likely to be retained after processing and give higher dye stain.

Yamashita and Kobayashi (JP 10/171058) describe silver halide photographic emulsions that contain an anionic dye and a cationic dye, where the charge of either the anionic dye or the cationic dye is 2 or greater. Tadashi and Takashi describe (JP2001013614A) combinations of cyanine dyes wherein the log P for the dye combination is in a certain preferred range.

Further improvements in dye layering have been described in U.S. Pat. Nos. 6,143,486; 6,165,703; 6,329,133; 6,331,385; and 6,361,932. Useful antenna dyes (dyes in the outer layer of the multilayer) for dye layering that have less dye stain after processing were described in U.S. Pat. No. 6,312,883.

However, even with the improvements in dye layering technology to date it is still difficult to use emulsions with more than one layer of dye in practical photographic elements.

PROBLEM TO BE SOLVED BY THE INVENTION

Many antenna dyes to not function well in photographic systems. For example, after processing, they may increase the minimum density (Dmin) of the film or paper to unacceptable levels. Such dyes may also cause staining. Many antenna dyes form a second dye-layer but do not give the optimum increase in light absorption or sufficient photographic sensitivity. Thus, even with the improvements in dye layering technology to date, new antenna dyes are still needed.

SUMMARY OF THE INVENTION

This invention provides a silver halide photographic material comprising at least one silver halide emulsion comprising silver halide grains having associated therewith:

(a) a first dye (Dye 1) that is a cyanine dye capable of spectrally sensitizing a silver halide emulsion and that has at least one anionic substituent; and (b) a second dye (Dye 2) that is not a cyanine dye and that has at least one cationic substituent, wherein the log P of Dye 2, excluding any counterion, is less than 4.00 and greater than 1.00.

This invention also provides a silver halide photographic material comprising at least one silver halide emulsion comprising silver halide grains having associated therewith:

(a) at least one cyanine dye (Dye 1) that is capable of spectrally sensitizing a silver halide emulsion and that has at least one anionic substituent;

(b) a second dye (Dye 2) of formula II containing at least one cationic substituent,

II

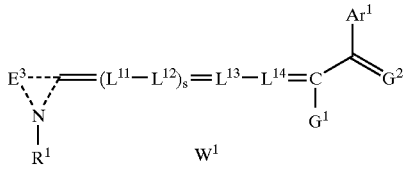

wherein:

$R^1$ is a substituted alkyl group that contains at least one tetraalkylammonium group and at least one additional heteroatom;

$E^3$ represents the atoms necessary to complete a substituted or unsubstituted 5- or 6-membered heterocyclic nucleus;

$Ar^1$ is a substituted or unsubstituted aryl group or a substituted or unsubstituted alkyl group;

$L^{11}$ through $L^{14}$ are substituted or unsubstituted methine groups;

s is 0 or 1;

$G^1$ is an electron-withdrawing group;

$G^2$ is O or dicyanovinyl ($C(CN)_2$); and $W^1$ is a counterion if necessary.

The photographic materials of this invention have enhanced light absorption and improved sensitivity. They also exhibit improved Dmin and less dye stain than other materials containing dye layered emulsions.

DETAILED DESCRIPTION OF THE INVENTION

The invention comprises a silver halide photographic material comprising at least one silver halide emulsion comprising silver halide grains having associated therewith at least one dye that is a cyanine dye (Dye 1) having at least one anionic substituent and at least one dye (Dye 2) that is not a cyanine dye and that has at least one cationic substituent. Dye 2 must either have an estimated log P, excluding any counterions, of less than 4.00 and greater than 1.00 and more preferably in the range of 3.5 to 2.0; or be represented by formula II discussed below, or may meet both criteria. Preferably the silver halide emulsion has more than one dye layer on the silver halide grains. Grains having multilayered dyes can afford increased light absorption and enhanced photoresponse. The dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation-π interactions, etc., or by in situ bond formation. The inner dye layer(s) is adsorbed to the silver halide grains and contains at least one spectral sensitizer. The outer dye layer(s) (also referred to herein as an antenna dye) absorbs light at an equal or higher energy (equal or shorter wavelength) than the adjacent inner dye layer(s). The light energy emission wavelength of the outer dye layer overlaps with the light energy absorption wavelength of the adjacent inner dye layer. In one embodiment of the invention the inner dye layer comprises at least Dye 1 and the outer Dye layer comprises at least Dye 2.

Dye 1 must have at least one anionic substituent. Examples of anionic substituents are alkyl groups containing acid salts. Acid salts are salts of sulfonic acids, sulfato groups, salts of phosphonic acids, salts of carboxylic acids, and salts of nitrogen acids, such as imides, N-acylsulfonamides, and N-sulfonylsulfonamides. The preferred acid salt substituents are salts of sulfonic acids, carboxylic acids, and nitrogen acids. The alkyl groups bearing the acid salt substituent may be further substituted. Some specific examples of preferred alkyl groups with acid salt substituents include, but are not limited to: 2-sulfoethyl, 3-sulfopropyl, 3-sulfobutyl, 4-sulfobutyl, 3-sulfo-2-hydroxypropyl, sulfoethylcarbamoylmethyl, 2-carboxyethyl, 3-carboxypropyl, 2-sulfo-2-carboxyethyl, methanesulfonylcarbamoylmethyl, and the like. Examples of suitable dyes for Dye 1 are described in "Technology Useful in Combination With Antenna Dyes" IP.com, Publication 000006637D, (IPCOM000006637D), published Jan. 17, 2002, pp. 1–51. In one embodiment of this invention, Dye 1 is of formula I (I)

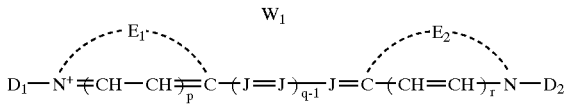

wherein:

$E_1$ and $E_2$ may be the same or different and represent the atoms necessary to form a substituted or unsubstituted heterocyclic ring which is a basic nucleus (see *The Theory of the Photographic Process,* 4th edition, T. H. James, editor, Macmillan Publishing Co., New York, 1977 for a definition of basic and acidic nucleus);

each J independently represents a substituted or unsubstituted methine group;

q is a positive integer of from 1 to 4;

p and r each independently represents 0 or 1;

$D_1$ and $D_2$ each independently represents substituted or unsubstituted alkyl or substituted or unsubstituted aryl and at least one of $D_1$ and $D_2$ contains an anionic substituent; and $W_1$ is one or more counterions as necessary to balance the charge;

It is preferred that the antenna dye, Dye 2, be highly fluorescent and that it also be able to form a liquid crystal phase in aqueous gelatin. It is also preferred that the antenna dye at least partially bleach or wash out of the photographic element during processing, since any retained dye contributes to the minimum density. The performance of the antenna dye can be improved, that is the dye can give increased photographic sensitivity (speed) and reduced dye stain (optical density due to retained dye), by changing substituents on the dye to optimize the partition coefficient of the dye (log P).

Dye 2 must have at least one cationic substitutent. The term "cationic substituent" includes a substituent, which can be protonated to become a cationic substituent. Examples of positively charged substituents are 3-(trimethylammonio) propyl), 3-(4-ammoniobutyl), 3-(4-guanidinobutyl) etc. Other examples are any substitutents that take on a positive charge in the silver halide emulsion melt, for example, by protonation such as aminoalkyl substitutents, e.g. 3-(3-aminopropyl), 3-(3-dimethylaminopropyl), 4-(4-methylaminopropyl), etc.

In one embodiment of this invention, Dye 2 is a merocyanine dye, arylidene dye, complex merocyanine dye, styryl dye, hemioxonol dye, oxonol dye, anthraquinone dye, triphenylmethane dye, azo dye type, azomethine dye, or a coumarin dye. More preferrably Dye 2 is a merocyanine dye. A merocyanine dye has one basic nucleus and one acidic nucleus separated by a conjugated chain having an even number of methine carbons (see *The Theory of the Photographic Process,* $4^{th}$ edition, T. H. James, editor, Macmillan Publishing Co., New York, 1977 for an explanation of basic and acidic nuclei).

In another embodiment of this invention, (Dye 2) is represented by the following formula II,

II

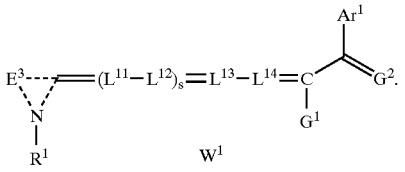

$Ar^1$ is a substituted or unsubstituted aryl group, for exampl, a phenyl, p-cyanophenyl, m-cyanophenyl, naphthyl, etc.; a heteroaryl group, for example, a pyridyl, m-bromopyridyl; or a substituted or unsubstituted alkyl group, preferabley having six carbons or less such as methyl, ethyl, etc. $L^{11}$ through $L^{14}$ are substituted or unsubstituted methine groups and s is 0 or 1;

$G^1$ is an electron-withdrawing group; the Hammett value for $G^1$ (see C. H. Hansch, A. Leo, and R. W. Taft, *Chem. Rev.,* 91, 165–195, (199 1) for a description of Hammett values) should be at least 0.20. Examples of $G^1$ are cyano, acetyl, trifluoromethyl, etc. $G^2$ is O or dicyanovinyl ($C(CN)_2$). $W^1$ is a counterion if necessary. Examples of useful counterions are bromide, tosylate, mesylate, glycolate, etc.

At least one substituent on the dye of formula II is cationic or can be protonated to become a cationic substituent as described above.

$E^3$ represents the atoms necessary to complete a substituted or unsubstituted 5- or 6-membered heterocyclic nucleus. These include, for example, a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art. Examples of useful nuclei for $E^3$include: a thiazole nucleus, e.g., thiazole, 4-methylthiazole, 4-phenylthiazole, 5-methylthiazole, 5-phenylthiazole,-4, 5-dimethyl-thiazole, 4,5-diphenylthiazole, 4-(2-thienyl) thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-hydroxybenzothiazole, 6-ethoxy-5-hydroxybenzothiazole, naphtho[2,1-d]thiazole, 5-ethoxynaphtho[2,3-d]thiazole, 8-methoxynaphtho[2,3-d]thiazole, 7-methoxynaphtho[2,3-d]thiazole, 4'-methoxythianaphtheno-7',6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6hydroxybenzoxazole, naphtho[2,1-d]oxazole, naphtho [1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4pyridine, 3-methyl-4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7methyl-4-quinoline, 8-chloro-4-quinoline, etc.; a tellurazole nucleus, e.g., benzotellurazole, naphtho [1,2-d]benzotellurazole, 5,6-dimethoxybenzotellurazole, 5-methoxybenzotellurazole, 5-methylbenzotellurazole; a thiazoline nucleus, e.g.,thiazoline, 4-methylthiazoline, etc.; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5trimethylindole; or a diazole nucleus, e.g., 5-phenyl-1,3,4oxadiazole, and 5-methyl-1,3,4-thiadiazole. In one preferred embodiment, $E^3$ represents the atoms necessary to complete a substituted or unsubstituted benzoxazole, benzothiazole, or quinoline nucleus.

$R^1$ is an alkyl group, preferably one having 2 to 8 carbon atoms, for example, but not limited to, an ethyl, propyl, butyl or pentyl group, and may be straight chained or branched. In one preferred embodiment of this invention, $R^1$ of formula II contains at least one tetraalkylammonium group and at least one additional heteroatom and more preferably at least two additional heteroatoms. In one preferred embodiment the heteroatom is an oxygen atom. In another preferred embodiment $R^1$ of formula II does not contain an aromatic or heteroaromatic group. These groups can sometimes increase dye stain. Representative examples of $R^1$ are given in Table E-2.

In another preferred embodiment of this invention, $R^1$ of formula II contains at least one tetraalkylammonium group and at least one additional heteroatom and more preferably at least two additional heteroatoms and $Ar^1$ of formula II is substituted with an electron-withdrawing group. The combination of these two elements in the structure of dye 2 can give improved performance, for example, less post-process dye stain. Examples of useful dyes include dyes of formula II in which $Ar^1$ is an aryl group which has one or more substituents, including the possibility of fused aromatic rings, and at least one of the substituents of $Ar^1$ has a Hammett value greater or equal to 0.25 and more preferably a Hammett value of 0.40 or greater. Substituent Hammett values are well known in the literature, for example, see C. H. Hansch, A. Leo, and R. W. Taft, *Chem. Rev.,* 91, 165–195, (1991). Preferably the Hammett $\sigma_m$ value would be used for meta substitutents and the $\sigma_p$ value would be used for para or ortho substitutents. Examples of useful substitutents for $Ar^1$ are m-CN, p-CN, o-CN, m-$SO_2CF_3$, p-$SO_2CF_3$, p-$COCF_3$, m-$COCF_3$, m-$SO_2Et$, p-$SO_2Et$, m-CHO, p-CHO, etc. Another example of useful dyes includes dyes of formula II in which $Ar^1$ is a heteroaromatic group that is an electron-withdrawing. In this case the heteroatom can be treated as a substituent and replacement substituent constants can be used to define the heteroaryl group's electron-withdrawing ability. Hammett replacement constants are discussed in *Correlation Analysis in Chemistry*, N. B. Chapman and J. Shorter, editors, Plenum Press, New York, 1978 and are defined for the replacement of —CH— or —CH═CH— in benzene by a heteroatom. The heteroaryl group should have a Hammett replacement substituent constant of 0.25 or greater.

TABLE E-2

| Examples of $R^1$. |
|---|
| R-1 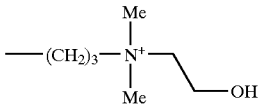 |
| R-2 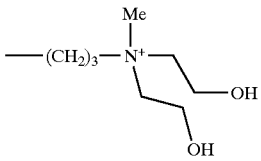 |
| R-3 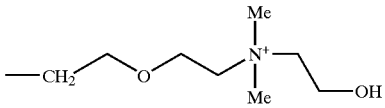 |
| R-4 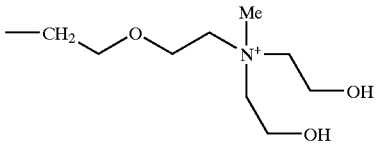 |

TABLE E-2-continued

| Examples of $R^1$. |
|---|
| R-5 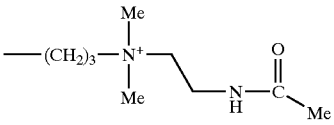 |
| R-6 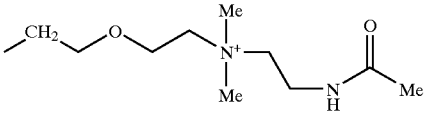 |
| R-7 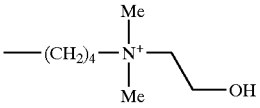 |
| R-8 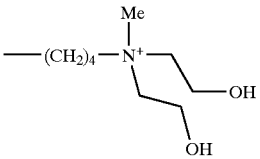 |
| R-9 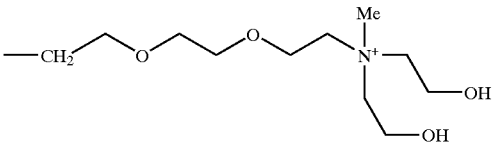 |
| R-10 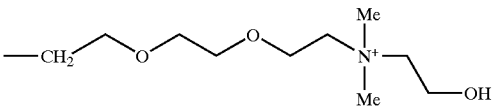 |
| R-11 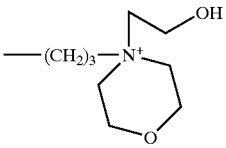 |

TABLE E-2-continued

| Examples of $R^1$. |
|---|
| R-12 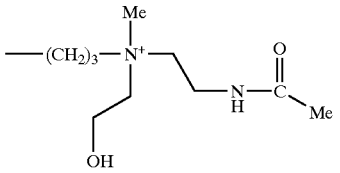 |
| R-13 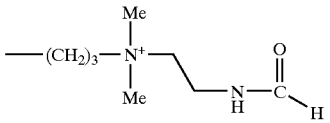 |
| R-14 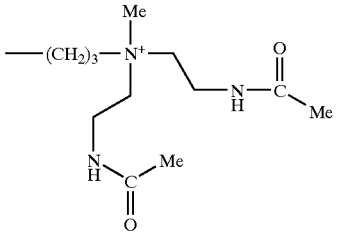 |
| R-15 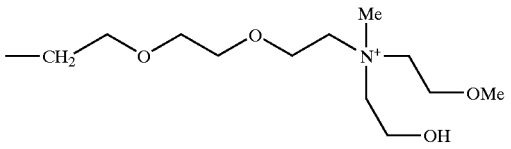 |
| R-16 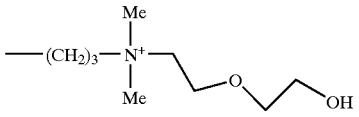 |
| R-17 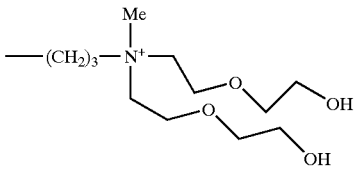 |
| R-18 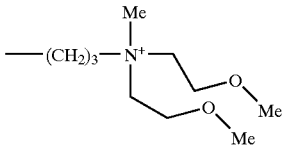 |
| R-19 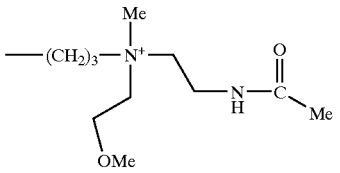 |

TABLE E-2-continued

| Examples of $R^1$. |
|---|
| R-20 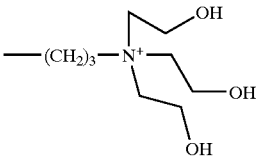 |

The estimated log P of the dye represented by formula II, excluding the counterion $W^1$, is preferably less than 4.00 and greater than 1.00. In a more preferred embodiment the estimated log P of the dye represented by formula II, excluding the counterion $W^1$, is less than 3.5 and greater than 2.0. The octanol/water partition coefficient (P) of a compound is the ratio of the amount of material that dissolves in the octanol phase divided by the concentration in the aqueous phase at equilibrium. LogP is often used to describe the relative tendency of a molecule to favor an oil (octanol) or water phase (see Leo and Hansch, "Substituent Constants for Correlation Analysis in Chemistry and Biology," Wiley, New York, 1979, and in Leo, Hansch, and Elkins, *Chem. Rev.,* 6, 525, (1971)). It is a measure of how hydrophobic or hydrophilic the molecule is. In this case, if the antenna dye (dye 2) is too hydrophobic (log P is large) it may not properly form a second dye layer. When added to an emulsion melt it may precipitate in the aqueous environment. Or, in a color system, where large droplets of coupler solvent are present, which can act like an organic solvent (similar to octanol), the antenna dye may partition into the coupler dispersion instead of forming a second dye layer. Even if an antenna dye with a high log P does form a second dye layer it will be difficult remove the dye from the photographic element (wash the dye out) with aqueous processing solutions. Thus, much of the dye will be retained leading to an undesirable increase in Dmin due to dye stain. If the antenna dye is too hydrophilic it may prefer, in an emulsion melt, to remain in the aqueous phase and not form a second dye layer. Thus, there is a preferred hydrophobicity/hydrophilicity range for antenna dyes that will give optimum performance in a photographic element. This range of optimum performance can be described by log P values.

It can be difficult to measure partition coefficients for dye molecules; however, methods have been developed for calculating a log P from a compounds molecular structure. For example, the KOWWIN© program Version 1.6, developed by the SYRACUSE RESEARCH CORPORATION, Environmental Science Center, 6225 Running Ridge Road, North Syracuse, N.Y. 13212-2510 is such a program.

Some estimated log P values, derived using the KOWWIN© program Version 1.6, are given below for antenna dyes of interest (Table E-1). These values were calculated for the dye chromophore and do not include the counterion. The counterion is not included because when the dye is added to an emulsion melt, which contains a large number of inorganic ions, it is likely that the counterion for the dye changes. It can be seen from Table E-1 that merocyanine dyes of the invention such as II-1 and II-2 (also see Table E-4) have significantly lower estimated log P values than comparison merocyanine dyes such as C-1 and C-2 respectively. They also have very low estimated log P values relative to cyanine dyes such as C-3 and C-4 described in Tadashi and Takashi (JP2001013614A).

TABLE E-1
Examples of dyes and their estimated LogP values.
| Example | Est. LogP | Structure (Dye Type) |
|---|---|---|
| II-1 | 3.10 | 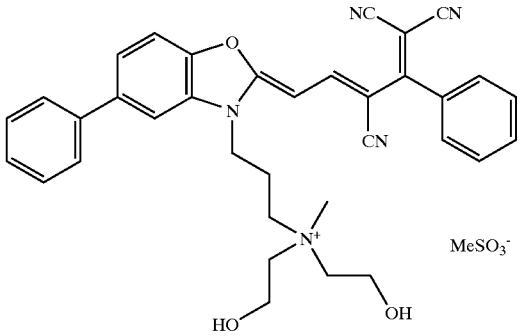 (Merocyanine) |
| II-2 | 2.65 | 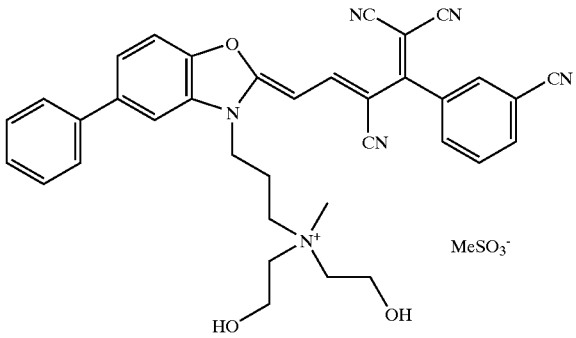 (Merocyanine) |
| C-1 | 4.64 | 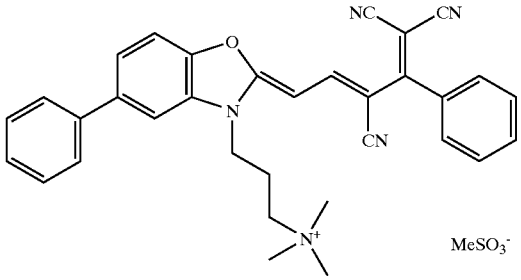 (Merocyanine) |
| C-2 | 4.19 | 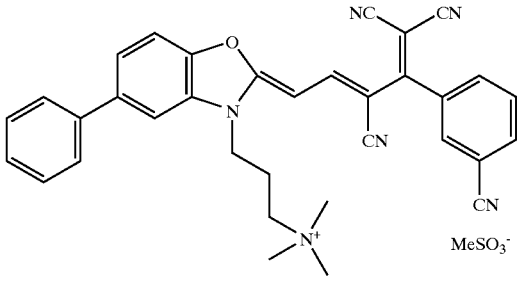 (Merocyanine) |

TABLE E-1-continued

Examples of dyes and their estimated LogP values.

| Example | Est. LogP | Structure (Dye Type) |
|---|---|---|
| C-4 | 10.00 | 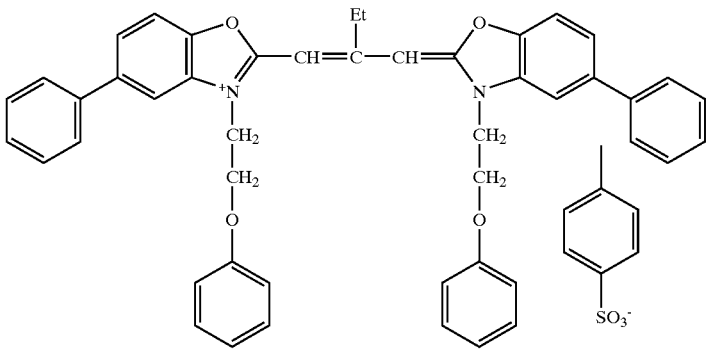 (Cyanine) |
| C-5 | 11.8 | 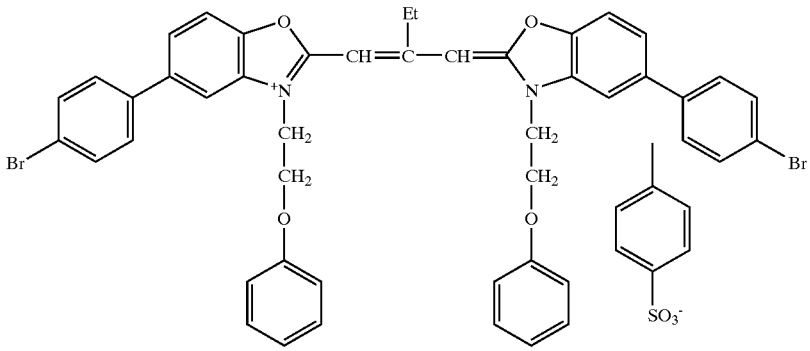 (Cyanine) |

In another preferred embodiment, Dye 2 can be represented by formula IIb,

IIb

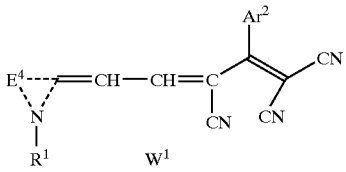

wherein $R^1$ and $W^1$ are as described above.

$Ar^2$ represents a substituted or unsubstituted aromatic group, for example a phenyl, p-cyanophenyl, m-cyanophenyl, naphthyl, etc.; a heteroaryl group, such as a pyridyl, m-bromopyridyl. Preferably at least one of the substituents of $Ar^2$ has a Hammett value greater or equal to 0.25 and more preferably a Hammett value of 0.40 or greater. $Ar^2$ can also be a heteroaromatic group that is an electron-withdrawing as described above for $Ar^1$. $E^4$ represents the atoms necessary to complete a substituted or unsubstituted benzoxazole, benzothiazole, or quinoline nucleus.

In another preferred embodiment Dye 2 can be represented by formula IIc,

IIc

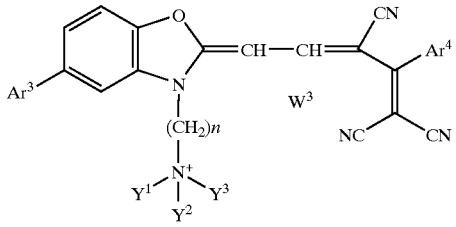

wherein $Y^1$, $Y_2$, and $Y^3$ independently represent substituted or unsubstituted alkyl groups, preferably having 1 to 6 carbon atoms. $Ar^3$ and $Ar^4$ independently represent substituted or unsubstituted aromatic groups. Examples of $Ar^3$ are phenyl, naphthyl, pyrrol-1-yl, etc. Examples of $Ar^4$ are phenyl, m-cyanophenyl, p-cyanophenyl, 3-pyridyl, etc. n represents an integer from 3 to 5 and $W^3$ is a counterion. Preferably at least one of the substituents of $Ar^4$ has a Hammett value greater or equal to 0.25 and more preferably a Hammett value of 0.40 or greater. $Ar^4$ can also be a heteroaromatic group that is an electron-withdrawing as described above for $Ar^1$.

In one preferred embodiment, $Y^1$, $Y^2$, and $Y^3$ of formula IIc independently represent hydroxyethyl or methyl, $Ar^3$ and $Ar^4$ represent substituted or unsubstituted phenyl groups, and n is 3 or 4.

In another preferred embodiment Dye 2 can be represented by formula IId,

IId

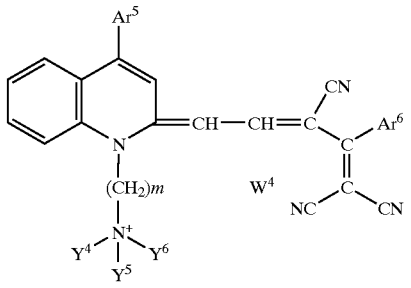

wherein $Y^4$, $Y^5$, and $Y^6$ independently represent substituted or unsubstituted alkyl groups, preferably having 1 to 6 carbon atoms, for example hydroxyethyl or methyl. $Ar^5$ represents a substituted or unsubstituted phenyl group and the quinoline nucleus of formula IId may be further substituted. $Ar^6$ represents a substituted or unsubstituted aromatic group; for example, a phenyl, m-cyanophenyl, p-cyanophenyl, 3-pyridyl, etc. Preferably at least one of the substituents of $Ar^6$ has a Hammett value greater or equal to 0.25 and more preferably a Hammett value of 0.40 or greater. m represents an integer from 3 to 5 and $W^4$ is a counterion. $Ar^6$ can also be a heteroaromatic group that is an electron-withdrawing as described above for $Ar^1$.

Table E-3 contains no-limiting examples of the dyes of formula I. Table E-4 contains non-limiting examples of the dyes of formula II.

TABLE E-3

I-1

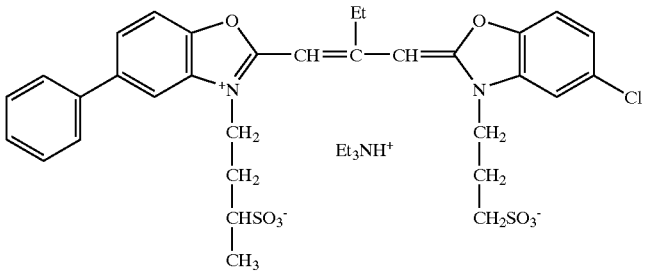

I-2

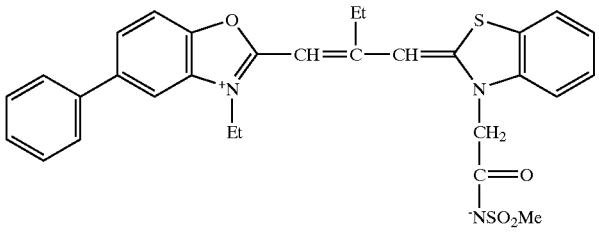

I-3

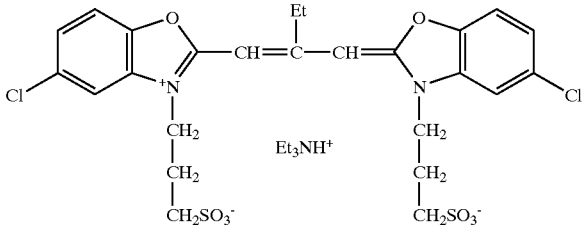

I-4

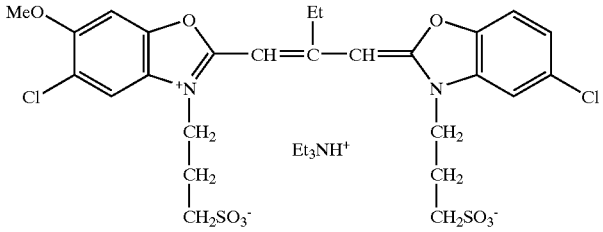

TABLE E-3-continued
I-5
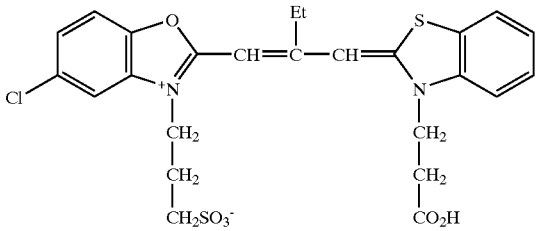
I-6
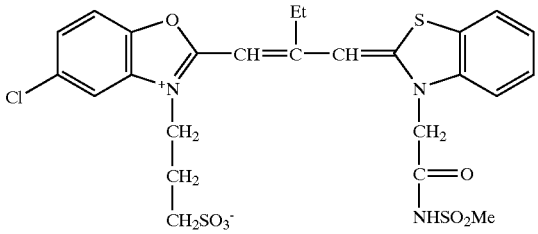
I-7
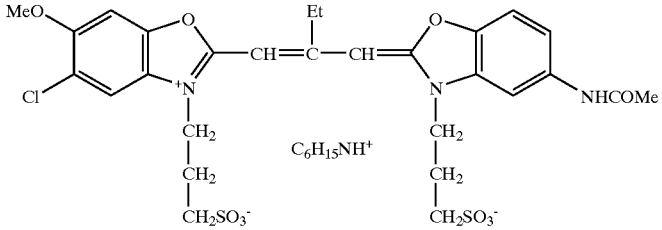
I-8
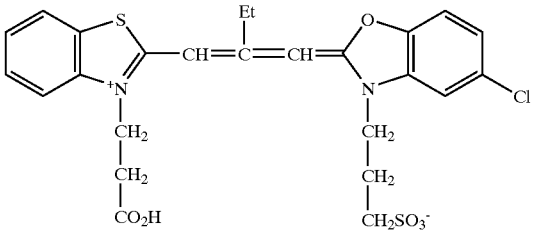
I-9
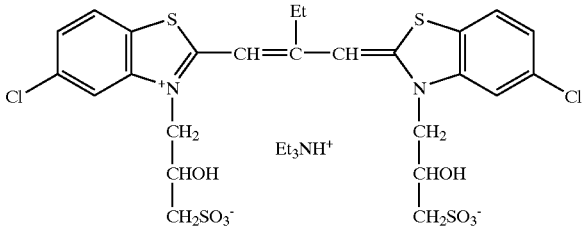
I-10
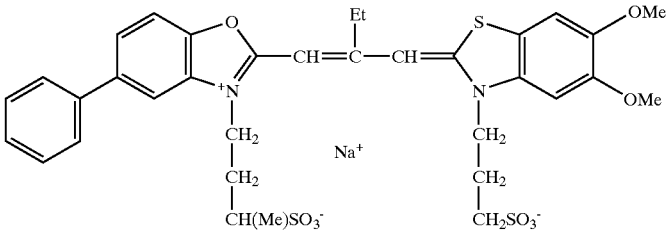

TABLE E-3-continued
| | |
|---|---|
| I-11 | 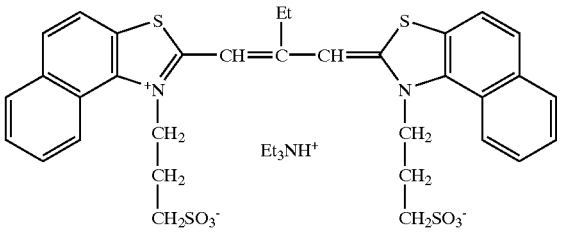 |
| I-12 | 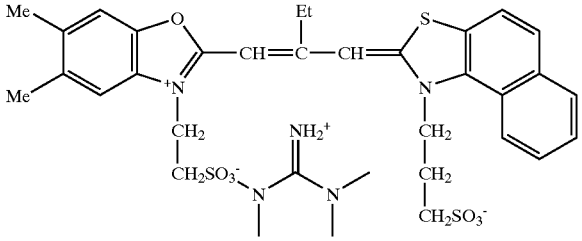 |
| I-13 | 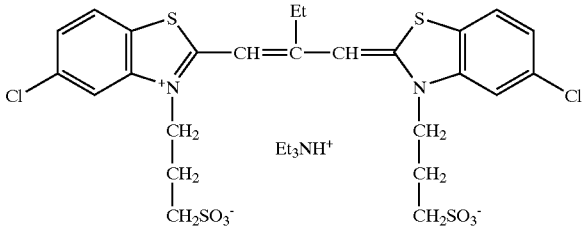 |
| I-14 | 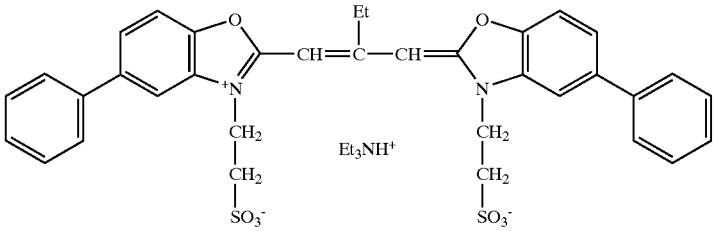 |
TABLE E-4
| Example | Estimated LogP of Chromophore | Structure |
|---|---|---|
| II-1 | 3.10 | 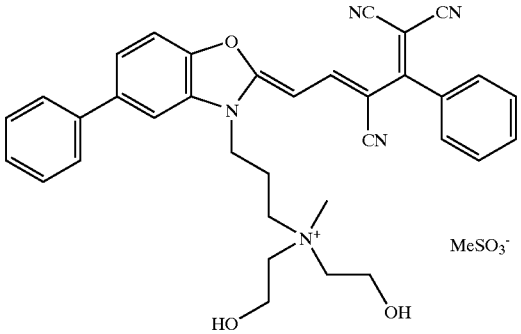 |

TABLE E-4-continued
| Example | Estimated LogP of Chromophore | Structure |
|---|---|---|
| II-2 | 2.65 | 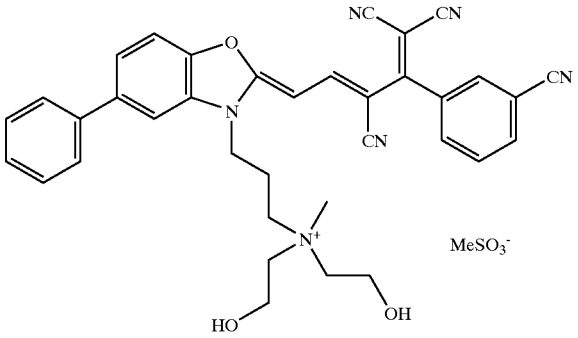 |
| II-3 | 2.80 | 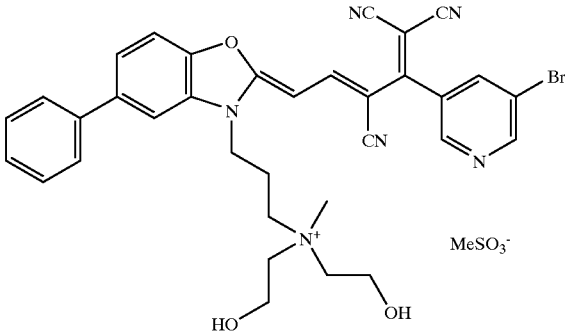 |
| II-4 | 3.21 | 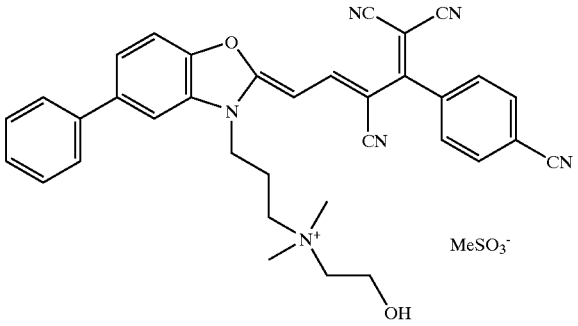 |
| II-5 | 2.64 | 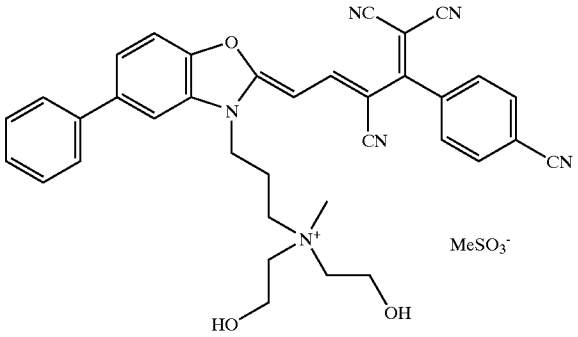 |

TABLE E-4-continued
| Example | Estimated LogP of Chromophore | Structure |
|---|---|---|
| II-6 | 3.15 | 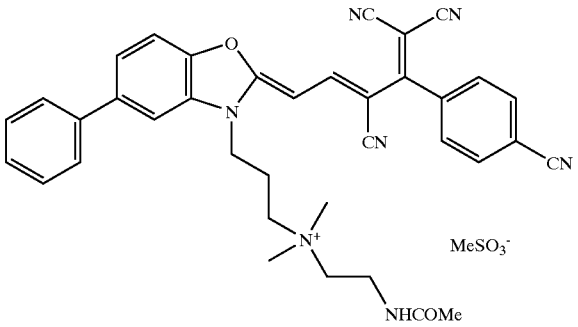 |
| II-7 | 2.63 | 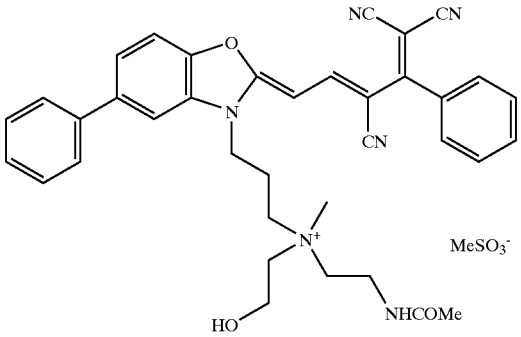 |
| II-8 | 3.60 | 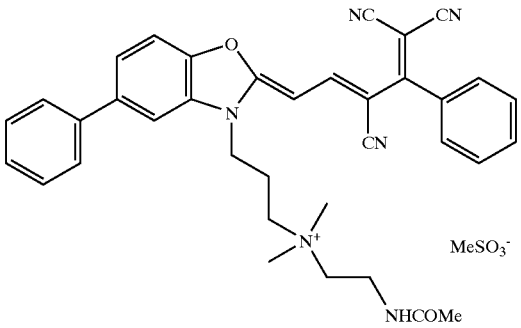 |
| II-9 | 3.57 | 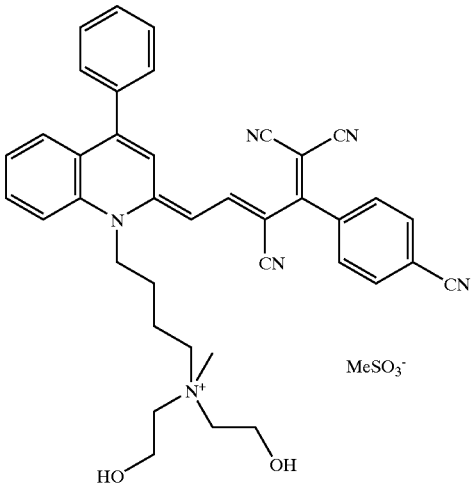 |

TABLE E-4-continued

| Example | Estimated LogP of Chromophore | Structure |
|---|---|---|
| II-10 | 3.57 | 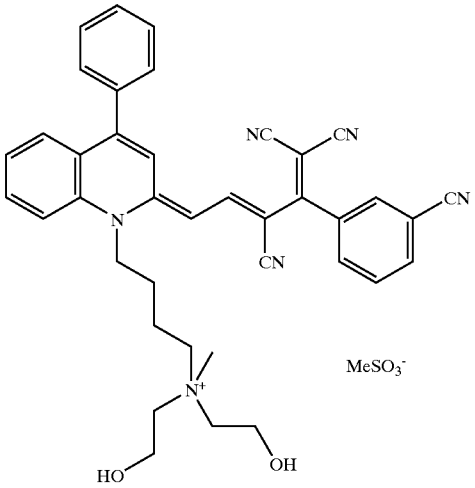 |
| II-11 | 2.31 | 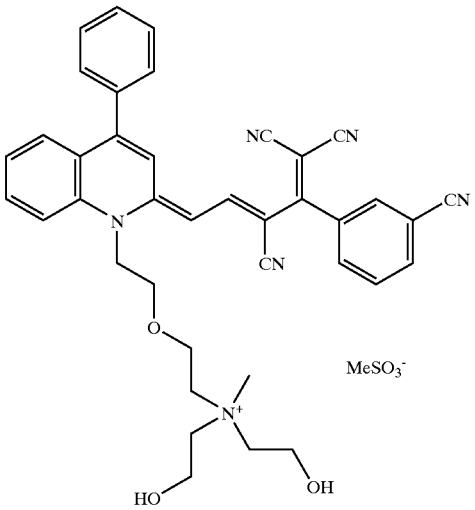 |
| II-12 | 3.10 | 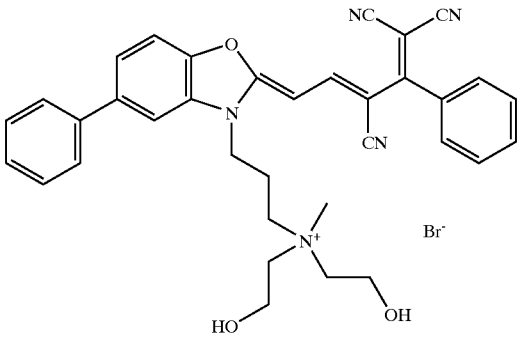 |

Dyes of formula I and II can be prepared by methods such as described in F. M. Hamer, *Cyanine Dyes and Related Compounds,* 1964 (publisher John Wiley & Sons, New York, N.Y.), *The Theory of the Photographic Process,* 4$^{th}$ edition, T. H. James, editor, Macmillan Publishing Co., New York, 1977 and U.S. Pat. No. 5,213,956.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecyl amino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In one embodiment of the invention the emulsion containing the dye layered grains containing the antenna dye described herein is in the magenta dye forming unit.

If desired, the photographic element can be used in conjunction with an applied magnetic layer as described in

*Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. More preferably the elements are negative working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755 A and 2,017,704 A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g,. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

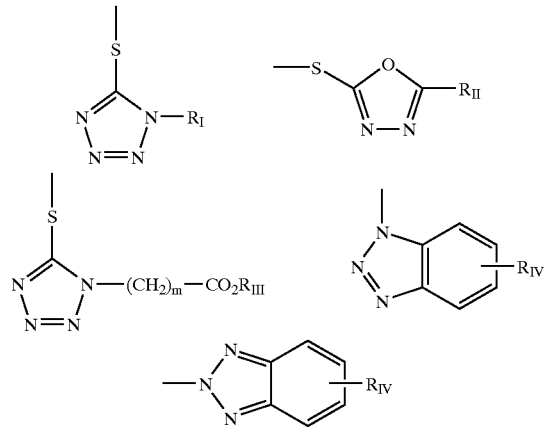

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

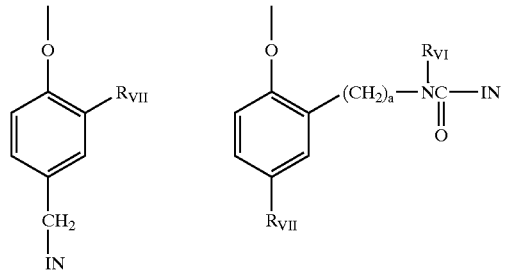

wherein IN is the inhibitor moiety, $R_{VII}$ is selected from the group consisting of nitro, cyano, alkylsulfonyl; sulfamoyl;

and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

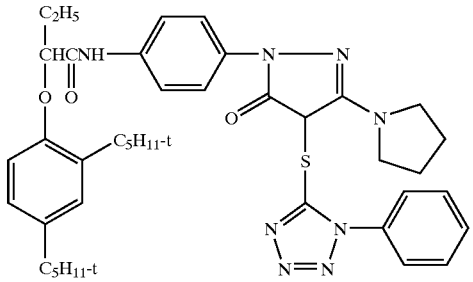

D2

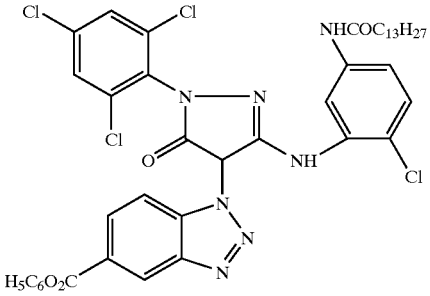

D3

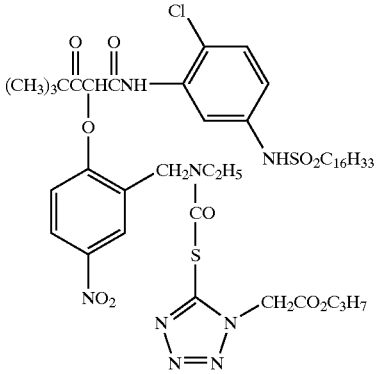

-continued

D4

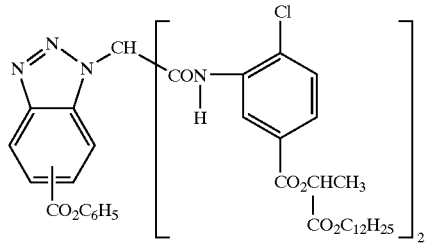

D5

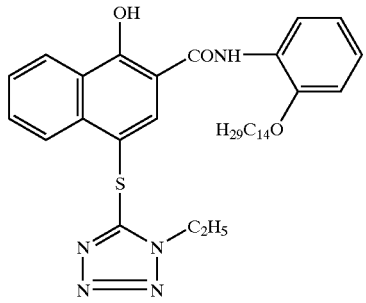

D6

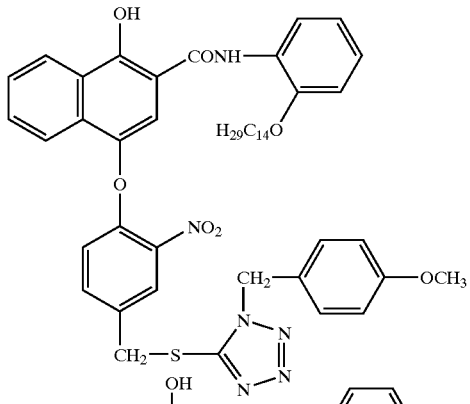

D7

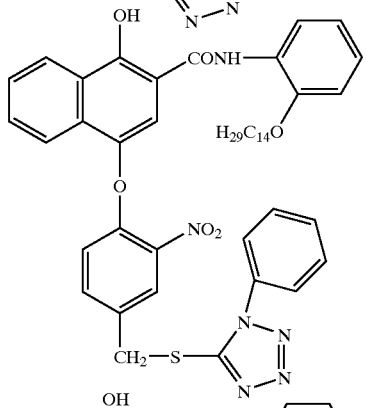

D8

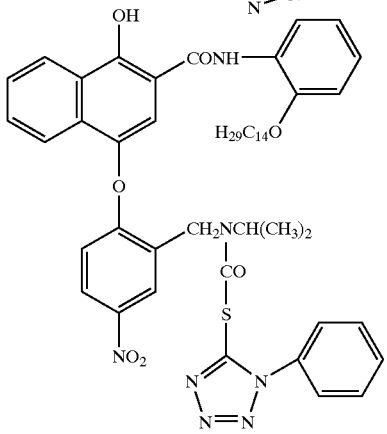

-continued

D9

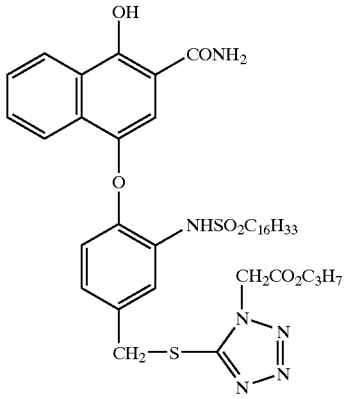

D10

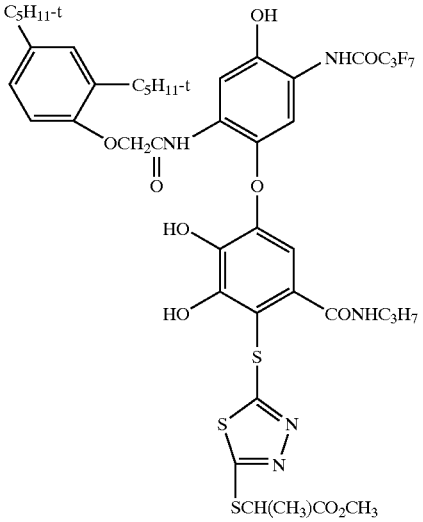

D11

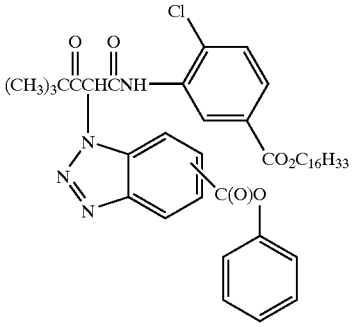

D12

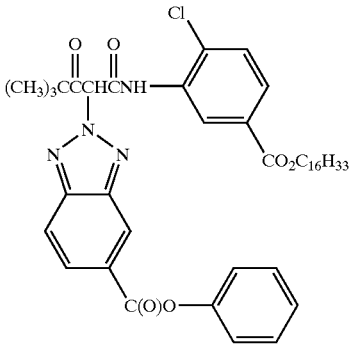

The silver halide used in the photographic elements may be silver iodobromide, silver bromide, silver chloride, silver chlorobromide, silver chloroiodobromide, and the like. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are hereby incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 $\mu$m. Most preferably the average thickness of the tabular grains is less than 0.2 $\mu$m. In a specific preferred form the tabular grains are ultrathin—that is, their average thickness is less than 0.07 $\mu$m.

The useful average grain ECD of a tabular grain emulsion can range up to about 15 $\mu$m. Except for a very few high speed applications, the average grain ECD of a tabular grain emulsion is conventionally less than 10 $\mu$m, with the average grain ECD for most tabular grain emulsions being less than 5 $\mu$m.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, Maskasky et al U.S. Pat. Nos. 5,176,992 and 5,178,998, Takada et al U.S. Pat. No. 4,783,398, Nishikawa et al U.S. Pat. No. 4,952,508, Ishiguro et al U.S. Pat. No. 4,983,508, Tufano et al U.S. Pat. No. 4,804,621, Maskasky and Chang U.S. Pat. No. 5,178,998, and Chang et al U.S. Pat. No. 5,252,452. Ultrathin high chloride {111} tabular grain emulsions are illustrated by Maskasky U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are hereby incorporated by reference.

Preferred high chloride tabular grain emulsions are {100} tabular grain emulsions, as illustrated by the following patents, here incorporated by reference: Maskasky U.S. Pat. Nos. 5,264,337, 5,292,632, 5,275,930, 5,607,828 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904, 5,663,041, and 5,744,297, Budz et al U.S. Pat. No. 5,451,490, Reed et al U.S. Pat. No. 5,695,922, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 4,173,320 and 5,411,851 5,418,125, 5,492,801, 5,604,085, 5,620,840, 5,693,459, 5,733,718, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175, 5,612,176 and 5,614,359, and Irving et al U.S. Pat. Nos. 5,695,923, 5,728,515 and 5,667,954, Bell et al U.S. Pat. No. 5,132,203, Brust U.S. Pat. Nos. 5,248,587 and 5,763,151,. Chaffee et al U.S. Pat. No. 5,358,840, Deaton et al U.S. Pat. No. 5,726,007, King et al U.S. Pat. No. 5,518,872, Levy et al U.S. Pat. No. 5,612,177, Mignot et al U.S. Pat. No. 5,484,697, Olm et al U.S. Pat. No. 5,576,172, Reed et al U.S. Pat. Nos. 5,604,086 and 5,698,387.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain comers and elsewhere along the edges can be realized. For example, Fenton et al U.S. Pat. No. 5,476,76 discloses lower iodide concentrations at the comers of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. Especially useful dopants are disclosed by Marchetti, et al., U.S. Pat. No. 4,937,180, and Johnson, et al., U.S. Pat. No. 5,164,292. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

SET dopants are known to be effective to reduce reciprocity failure. In particular the use of $Ir^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is hereby incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference. The following example is intended to illustrate, but not to limit the invention.

PHOTOGRAPHIC EXAMPLE 1

Film coating evaluations were carried out in color format on a sulfur-and-gold sensitized 2.6 μm×0.13 μm silver bromide tabular emulsion containing 3.7 mole % iodide. Three emulsion melts were prepared. Each emulsion was heated to 43° C. and sodium thiocyanate (100 mg/Ag mole) was added. After a 5' hold, 3-(2-methylsulfamoylethyl)-benzothiazolium tetrafluoroborate (35 mg/Ag mole) was added followed by a 2' hold. Then the first sensitizing dye, I-1 was added. After a 20' hold, the second sensitizing dye, I-2, was added with a subsequent 10' hold. This was followed by the addition of sodium aurous dithiosulfate dihydrate (1.89 mg/Ag mole). After a 2' hold, sodium thiosulfate pentahydrate (0.84 mg/Ag mole) was added, followed by a 2' hold. The emulsion was held for 15' at 60° C. After cooling to 43° C., 1-(3-acetamidophenyl)-5-mercaptotetrazole (25 mg/Ag mole) was added with a subsequent hold for 2'. Then either no dye was added (Example 1—1) or 1.3 mmole/mole-Ag of either antenna dye C-1 (Example 1-2) or antenna dye II-1 (Example 1-3) was added followed by a 30' hold. Next, (2,5-dihydroxy-4-(1-methylheptadecy)-benenesulfonic acid, sodium salt) was added followed by a 2' hold. This was followed with the addition of Aerosol-OT and a 2' hold. Then, 4-hydroxy-6-methyl-1,3,3a,7-tetraazaindene, sodium salt, monohydrate, (1 g/Ag mole) was added and then held for 5'. The melt was subsequently chilled at 5° C. Before coating, the emulsion was combined with gelatin and distilled water; and subsequently heated to 40° C. to mix components. Single-layer coatings were made on acetate support. Silver laydown was 807 mg/m$^2$ (75 mg/ft$^2$). The silver melt was combined with a coupler dispersion containing a magenta forming coupler M-1 at a laydown of 226 mg/m$^2$ (21 mg/ft$^2$). Gelatin laydown was 3228 mg/m$^2$ (300 mg/ft$^2$). A hardened overcoat was at 2690 mg/m$^2$ (250 mg/ft$^2$) gelatin. The described elements were processed for 3.25' in the known C-41 color process. Sensitometric exposures (0.01 sec) were done using tungsten light with filtration to stimulate a daylight exposure. Results are shown in Table 1—1.

Granularity readings on processed strips were made according to procedures described in the SPSE Handbook of Photographic Science and Engineering, edited by W. Thomas, pp. 934–939. In Table 1—1, the relative granularity at Dmin is given in grain units. (g.u.), in which each g.u. represents a 5% change; positive and negative changes corresponding to grainier and less grainy images, respectively (i.e., negative changes are desirable).

Test for dye stain was done by processing in a developer-free pH-10 buffer solution for 3.25 minutes, followed by a bleach-wash-fix-wash cycle of 4'/3'/4'/4' respectively. The stain was measured as a density using a status M filter and the results are shown in Table 1—1.

It can be seen from the Table 1—1 that emulsions that contain antenna dyes (Examples 1-2 and 1-3) afford higher sensitivity than the emulsion (1—1) that does not contain an antenna dye. The emulsion (1-3) containing the inventive antenna dye II-1 resulted in about 50% lower Dmin and 30% lower dye stain than an emulsion (1-2) having antenna dye C-1. Under these conditions, dye II-1 also provided higher sensitivity and lower granularity than dye C-1.

TABLE 1-1

| Example | | Antenna Dye | Relative Dmin[1] | Relative Stain[1] | Relative Granularity | Normalized Relative Sensitivity[2] |
|---|---|---|---|---|---|---|
| I-1 | Comparison. | None | 0 | 0 | 0 | 100 |
| I-2 | Comparison | C-1 | 0.052 | 0.031 | 0 | 126 |
| I-3 | Invention | II-1 | 0.026 | 0.021 | −2 | 129 |

[1]Relative to comparison example I-1 wherein the emulsion has only one dye layer present.
[2]Measured at 0.15 density units above Dmin.

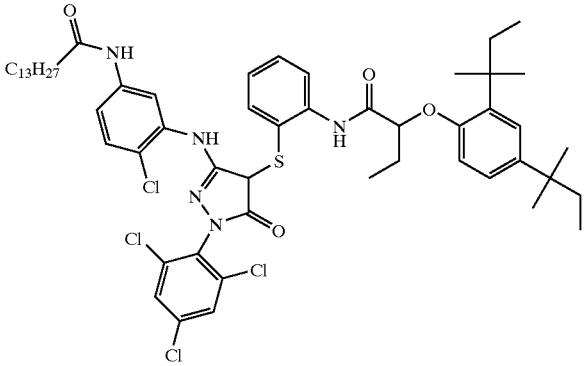

Coupler M-1

The invention has been described in detail with particular reference to certain preferred embodiments thereof, but it will be understood that variations and modifications can be effected within the spirit and scope of the invention.

What is claimed is:

1. A silver halide photographic material comprising at least one silver halide emulsion comprising silver halide grains having associated therewith:

(a) a first dye (Dye 1) that is a cyanine dye capable of spectrally sensitizing a silver halide emulsion and that has at least one anionic substituent; and (b) a second dye (Dye 2) that has at least one cationic substituent and is represented by formula II

II

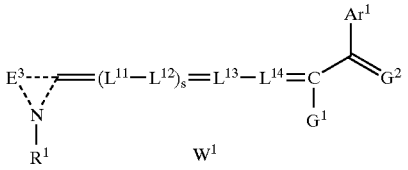

wherein:

$R^1$ is a substituted alkyl group that comprises at least one tetraalkylammonium group and at least one additional heteroatom;

$E^3$ represents the atoms necessary to complete a substituted or unsubstituted 5- or 6-membered heterocyclic nucleus;

$Ar^1$ is a substituted or unsubstituted aryl group or a substituted or unsubstituted alkyl group;

$L^{11}$ through L14 are substituted or unsubstituted methine groups;

s is 0 or 1;

$G^{11}$ is an electron-withdrawing group;

$G^2$ is O or dicyanovinyl ($C(CN)_2$); and $W^1$ is a counterion if necessary; and wherein the log P of Dye 2, excluding any counterion, is less than 4.00 and greater than 1.00.

2. The silver halide photographic material of claim 1, wherein Dye 2 is represented by formula IIb, IIb

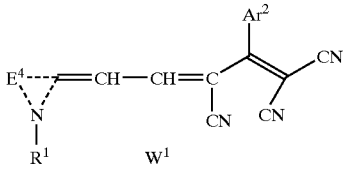

wherein:

$R^1$ is a substituted alkyl group that comprises at least one tetraalkylammonium group and at least one additional heteroatom;

$Ar^2$ represents a substituted or unsubstituted aromatic group, $E^4$ represents the atoms necessary to complete a substituted or unsubstituted benzoxazole, benzothiazole, or quinoline nucleus; and $W^1$ is a counterion if necessary.

3. The silver halide photographic material of claim 1, wherein $Ar^1$ is substituted with an electron-withdrawing group having a Hammett sigma value greater than 0.25.

4. The silver halide photographic material of claim 1, wherein $Ar^1$ is a substituted or unsubstituted heterocyclic aromatic group.

5. The silver halide photographic material of claim 2, wherein $Ar^2$ is substituted with an electron-withdrawing group having a Hammett sigma value greater than 0.25.

6. The silver halide photographic material of claim 1, wherein Dye 2 is described by formula IIc IIc

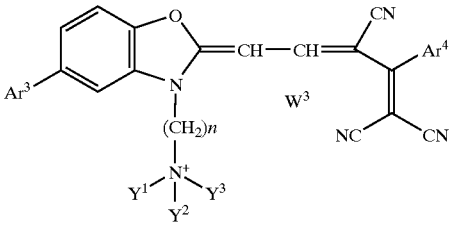

wherein:

$Y^1$, $Y^2$, and $Y^3$ independently substituted unsubstituted alkyl groups and at least one of $Y^1$, $Y^2$, and $Y^3$ comprises a heteroatom, $Ar^3$ and $Ar^4$ independently represent substituted or unsubstituted aromatic groups;

n represents an integer from 3 to 5; and $W^3$ is a counterion.

7. The silver halide photographic material of claim 6, wherein $Y^1$, $Y^2$, and $Y^3$ of formula IIc independently represent hydroxyethyl or methyl, $Ar^3$ and $Ar^4$ independently represent substituted or unsubstituted phenyl groups, and n is 3 or 4.

8. The silver halide photographic material of claim 6, wherein $Ar^4$ is substituted with an electron-withdrawing group having a Hammett sigma value greater than 0.25.

9. The silver halide photographic material of claim 1, wherein Dye 2 is described by formula IId IId

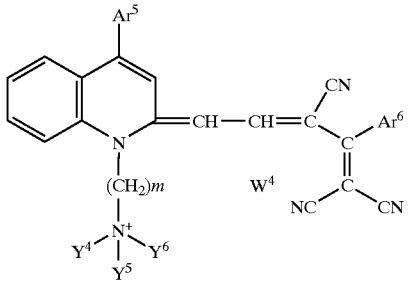

wherein: $Y^4$, $Y^5$, and $Y^6$ independently represent substituted or unsubstituted alkyl groups and at least one of $Y^4$, $Y^5$, and $Y^6$ comprises a heteroatom;

$Ar^5$ represents a substituted or unsubstituted phenyl group and the quinoline nucleus of formula lid may be further substituted, $Ar^6$ represents a substituted or unsubstituted aromatic group, m represents an integer from 3 to 5; and $W^4$ is a counterion.

10. The silver halide photographic material of claim 9, wherein $Ar^6$ is substituted with an electron-withdrawing group having a Hammett sigma value greater than 0.25.

11. The silver halide material of claim 1 wherein the silver halide emulsion comprises an inner dye layer comprising at least Dye 1 and an outer dye layer comprising at least Dye 2.

12. A silver halide photographic material comprising at least one silver halide emulsion comprising silver halide grains having associated therewith:

(a) at least one cyanine dye (Dye 1) that is capable of spectrally sensitizing a silver halide emulsion and that has at least one anionic substituent;

(b) a second dye (Dye 2) of formula IIc containing at least one cationic substituent, IIc

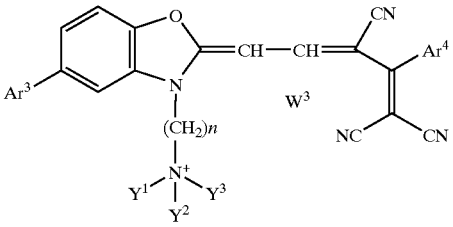

wherein:

$Y^1$, $Y^2$, and $Y^3$ independently represent substituted or unsubstituted alkyl groups, and at least one of $Y^1$, $Y^2$, and $Y^3$ comprises a heteroatom $Ar^3$ and $Ar^4$ independently represent substituted or unsubstituted aromatic groups;

n represents an integer from 3 to 5; and $W^3$ is a counterion.

13. The silver halide photographic material of claim 12 wherein $Y^1$, $Y^2$, and $Y^3$ of formula IIc independently represent hydroxyethyl or methyl, $Ar^3$ and $Ar^4$ independently represent substituted or unsubstituted phenyl groups, and n is 3 or 4.

14. The silver halide photographic material of claim 12 wherein $Ar^4$ is substituted with an electron-withdrawing group having a Hammett sigma value greater than 0.25.

15. The silver halide material of claim 12 wherein the silver halide emulsion comprises an inner dye layer comprising at least Dye 1 and an outer dye layer comprising at least Dye 2.

* * * * *

UNITED STATES PATENT AND TRADEMARK OFFICE

CERTIFICATE OF CORRECTION

PATENT NO. : 6,908,730 B2
DATED : June 21, 2005
INVENTOR(S) : David R. Foster et al.

It is certified that error appears in the above-identified patent and that said Letters Patent is hereby corrected as shown below:

Column 42,
Line 63, delete "$G^{11}$" and insert -- $G^{1}$ --.

Column 44,
Line 17, after "formula" delete "lid" and insert -- IId --.

Signed and Sealed this

Thirteenth Day of December, 2005

JON W. DUDAS
*Director of the United States Patent and Trademark Office*